US007669350B2

(12) United States Patent
Yoo et al.

(10) Patent No.: US 7,669,350 B2
(45) Date of Patent: Mar. 2, 2010

(54) DRYING METHOD OF LAUNDRY ROOM MACHINE AND DRYER THEREFOR

(75) Inventors: Hea-Kyung Yoo, Changwon-shi (KR); Tae-Hoon Lim, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 224 days.

(21) Appl. No.: 11/753,022

(22) Filed: May 24, 2007

(65) Prior Publication Data

US 2008/0047162 A1 Feb. 28, 2008

(30) Foreign Application Priority Data

May 26, 2006 (KR) ..... 10-2006-0047737

(51) Int. Cl.
*F26B 11/02* (2006.01)

(52) U.S. Cl. ..... 34/495; 34/557; 34/403; 34/524; 68/3 R; 73/355.02

(58) Field of Classification Search ..... 34/395, 34/557, 524, 403; 73/355.02; 68/3 R
See application file for complete search history.

(56) References Cited

U.S. PATENT DOCUMENTS 2,417,998 A * 3/1947 Wales ..... 68/12.22
2,654,160 A * 10/1953 Peterson ..... 34/543
2,991,641 A * 7/1961 Woodling ..... 68/20
3,122,358 A * 2/1964 Cobb et al. ..... 432/44
3,200,511 A * 8/1965 Smith ..... 34/529
3,203,107 A * 8/1965 Scofield ..... 34/550
3,203,679 A * 8/1965 Williams et al. ..... 432/44
3,210,863 A * 10/1965 Nye, Jr. et al. ..... 34/533
3,216,126 A * 11/1965 Brucken et al. ..... 34/527
3,217,422 A * 11/1965 Fuqua et al. ..... 34/527
3,221,417 A * 12/1965 Mellinger ..... 34/528
3,229,379 A * 1/1966 Heidtmann ..... 34/533
3,243,891 A * 4/1966 Smith ..... 34/528
3,253,346 A * 5/1966 Gosnell ..... 34/546
3,253,347 A * 5/1966 Kripke ..... 34/546
3,284,919 A * 11/1966 Gartley et al. ..... 34/550
3,287,817 A * 11/1966 Smith ..... 34/446
3,331,139 A * 7/1967 Francis et al. ..... 34/527
3,335,501 A * 8/1967 Janke et al. ..... 34/528

(Continued)

FOREIGN PATENT DOCUMENTS

CN 2195564 4/1995

(Continued)

OTHER PUBLICATIONS

Chinese Office Action dated Apr. 3, 2009.

*Primary Examiner*—Stephen M. Gravini
(74) *Attorney, Agent, or Firm*—KED & Associates, LLP

(57) ABSTRACT

A laundry room machine and a drying method thereof are provided. The laundry room machine may includes a payment device for collecting a payment for operation of the laundry room machine. The laundry room machine performs drying of laundry items for a preset dry time corresponding to a selected drying course. The drying method includes determining a condition of the laundry items by measuring a humidity level, and either sustaining the preset dry time or resetting a hot air supplying time and cooling time based on the determined condition of the laundry items.

8 Claims, 5 Drawing Sheets

U.S. PATENT DOCUMENTS

| | | | | | |
|---|---|---|---|---|---|
| 3,400,467 | A | * | 9/1968 | Drace | 34/529 |
| 3,417,480 | A | * | 12/1968 | Thunander | 34/528 |
| 3,613,253 | A | * | 10/1971 | Smith | 34/532 |
| 3,613,254 | A | * | 10/1971 | Smith | 34/527 |
| 3,651,579 | A | * | 3/1972 | Smith | 34/532 |
| 3,660,909 | A | * | 5/1972 | Willcox | 34/533 |
| 3,714,716 | A | * | 2/1973 | Dedrick | 34/495 |
| 3,733,712 | A | * | 5/1973 | Smith | 34/532 |
| 3,809,924 | A | * | 5/1974 | Grunow et al. | 307/125 |
| 3,811,198 | A | * | 5/1974 | Baltes | 34/466 |
| 4,180,919 | A | * | 1/1980 | Baltes | 34/449 |
| 4,209,915 | A | * | 7/1980 | Keuleman et al. | 34/549 |
| 4,466,202 | A | * | 8/1984 | Merten | 34/470 |
| 4,549,362 | A | * | 10/1985 | Haried | 34/395 |
| 4,649,654 | A | * | 3/1987 | Hikino et al. | 34/493 |
| 4,733,479 | A | * | 3/1988 | Kaji et al. | 34/446 |
| 4,763,425 | A | * | 8/1988 | Grennan | 34/552 |
| 4,797,656 | A | * | 1/1989 | Keppler | 340/539.26 |
| 4,916,291 | A | * | 4/1990 | Jan | 219/492 |
| 5,050,313 | A | * | 9/1991 | Wakaeya et al. | 34/454 |
| 5,315,765 | A | * | 5/1994 | Holst et al. | 34/260 |
| 5,570,520 | A | * | 11/1996 | Huffington | 34/535 |
| 5,651,192 | A | * | 7/1997 | Horwitz | 34/529 |
| 5,731,157 | A | * | 3/1998 | Miller et al. | 435/7.4 |
| 5,755,041 | A | * | 5/1998 | Horwitz | 34/491 |
| 5,899,005 | A | * | 5/1999 | Chen et al. | 34/528 |
| 6,079,121 | A | * | 6/2000 | Khadkikar et al. | 34/528 |
| 6,098,310 | A | * | 8/2000 | Chen et al. | 34/475 |
| 6,199,300 | B1 | * | 3/2001 | Heater et al. | 34/446 |
| 6,405,453 | B1 | * | 6/2002 | Salameh et al. | 34/491 |
| 6,941,678 | B2 | * | 9/2005 | Park | 34/528 |
| 7,005,618 | B2 | * | 2/2006 | Riddle et al. | 219/497 |
| 7,066,412 | B2 | * | 6/2006 | Conley et al. | 239/690 |
| 7,082,695 | B1 | * | 8/2006 | Wong et al. | 34/486 |
| 2002/0004995 | A1 | * | 1/2002 | France et al. | 34/524 |
| 2003/0097763 | A1 | * | 5/2003 | Morgan et al. | 34/468 |
| 2004/0211083 | A1 | * | 10/2004 | Park | 34/528 |
| 2005/0160620 | A1 | * | 7/2005 | Morgan et al. | 34/469 |
| 2005/0210703 | A1 | * | 9/2005 | Chung | 34/528 |
| 2005/0278974 | A1 | * | 12/2005 | Chung | 34/528 |
| 2006/0000110 | A1 | * | 1/2006 | Aisenberg et al. | 34/443 |
| 2006/0162182 | A1 | * | 7/2006 | Wong et al. | 34/486 |
| 2007/0017113 | A1 | * | 1/2007 | Scharpf et al. | 34/86 |
| 2007/0039200 | A1 | * | 2/2007 | Hwang | 34/474 |
| 2007/0175063 | A1 | * | 8/2007 | Morgan et al. | 34/467 |
| 2007/0283592 | A1 | * | 12/2007 | Slutsky | 34/446 |
| 2008/0005924 | A1 | * | 1/2008 | Yoo et al. | 34/524 |
| 2008/0047162 | A1 | * | 2/2008 | Yoo et al. | 34/495 |
| 2008/0052950 | A1 | * | 3/2008 | Park et al. | 34/524 |
| 2008/0072448 | A1 | * | 3/2008 | Hubig et al. | 34/446 |
| 2008/0189978 | A1 | * | 8/2008 | Aizpuru Borda et al. | 34/549 |
| 2009/0049708 | A1 | * | 2/2009 | Lee | 34/491 |

FOREIGN PATENT DOCUMENTS

| | | | |
|---|---|---|---|
| CN | 2754164 | | 1/2006 |
| JP | 03092200 | A * | 4/1991 |

* cited by examiner

DRYING METHOD OF LAUNDRY ROOM MACHINE AND DRYER THEREFOR

TECHNICAL FIELD

The present invention relates to a drying method of a laundry room machine, and more particularly, to a drying method of a commercial laundry room machine for adjusting a drying time according to a condition of the laundry and supplying hot air to the laundry according to the adjusted drying time, and a dryer therefor.

BACKGROUND ART

In general, a laundry room includes machine for washing and drying the laundry. Such a machine performs only one of a washing operation and a drying operation, or both of the washing operating and the drying operation.

FIG. 1 is a flowchart illustrating a drying method of a laundry room machine according to the related art.

Referring to FIG. 1, the conventional drying method includes a payment insertion step S1 for inserting a card or a coin, a course selection step S2 for selecting one of drying courses according to characteristics of the laundry by a user, a drying step S3 for heating and drying the laundry for a time set according to the course selected at the step S2, and a cooling step S4 for cooling the heated laundry down.

However, the conventional drying method has following shortcomings.

Since a user selects one of drying courses regardless of the moisture content of the laundry, the laundry may be over heated and damaged.

Since the drying operation is continuously performed for a drying time of a selected drying course regardless of the condition of the laundry, the laundry is continuously heated although the laundry does not need to be dried any longer. Therefore, energy is wasted.

Since a user cannot extend a drying time while the drying operation is performing, a user must control a laundry room machine to perform a drying operation again after the current drying operation ends.

DISCLOSURE OF THE INVENTION

The present invention is achieved to solve the above problems. An object of the present invention is to provide a drying method of a laundry room machine for preventing the laundry from being damaged by providing discriminative drying courses according to the moisture content of the laundry.

Another object of the present invention is to provide a drying method of a laundry room machine for saving energy by ending a drying operation if it is determined that the drying operation dose not need to be performed any longer by measuring a condition of the laundry.

Yet another object of the present invention is to provide a drying method of a laundry room machine for enabling a user to extend a drying operation while the drying operation is performing.

In order to achieve the above-described objects of the invention, there is provided a drying method of a laundry room machine that includes a payment device for collecting a payment for operating the laundry room machine and supplies a hot air to the laundry for a dry time set according to a selected drying course after receiving payment insertion information from the payment device, the drying method including the steps of: a) determining a condition of the laundry by measuring humidity; and b) sustaining the hot air supplying time or resetting the hot air supply time by adjusting the hot air supplying time according to the determined condition of the laundry.

The step a) may include the steps of a-1) extracting an average value of valid data measured for a sampling time for measuring humidity, and a-2) determining whether the extracted average value reaches a predetermined saturation value or not.

In the step b), if the extracted average value reaches to the predetermined saturation value within a predetermined time after the hot air is supplied, a hot air may be supplied until a current temperature reaches to a preset temperature and the supplement of hot air stops.

In the step b), a hot air may be supplied until a shorter time between a dry completion time calculated by a time when the extracted average value reaches the saturation value and the set dry time.

In the step b), when payment insertion information is additionally received after the supplement of hot air stops because the set dry time is adjusted, the hot air may be supplied again.

In another aspect of the present invention, there is provided a commercial dryer for a commercial laundry room, including: an interface for communicating payment collecting information with a payment device disposed at each dryer; a humidity sensor for measuring humidity of the laundry in the dryer; and a controlling unit for controlling operation of the dryer according to operating information set according to communicating information of the interface, and resetting a hot air supplying time for supplying hot air into the dryer according to information from a humidity sensor.

The controlling unit may adjust the operating information set according to communicating information of the interface according to additional payment insertion information. The controlling unit may reset a time of supplying a hot air into a dryer according to information from a humidity sensor within a time initially set according to communicating information of the interface.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

A drying method of a laundry room machine and a dryer therefor in accordance with preferred embodiments of the present invention will now be described in detail with reference to the accompanying drawings.

Figure 1:
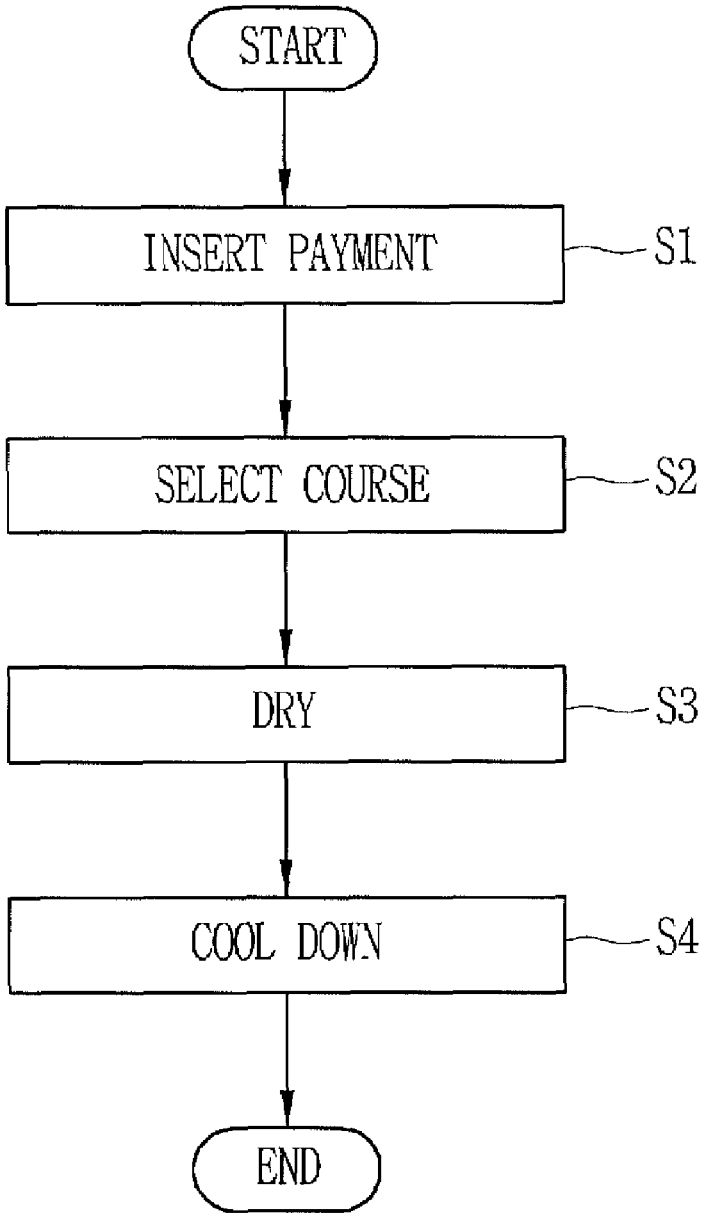
FIG. 1 is a flowchart illustrating a drying method of a laundry room machine according to the related art.
Figure 2:
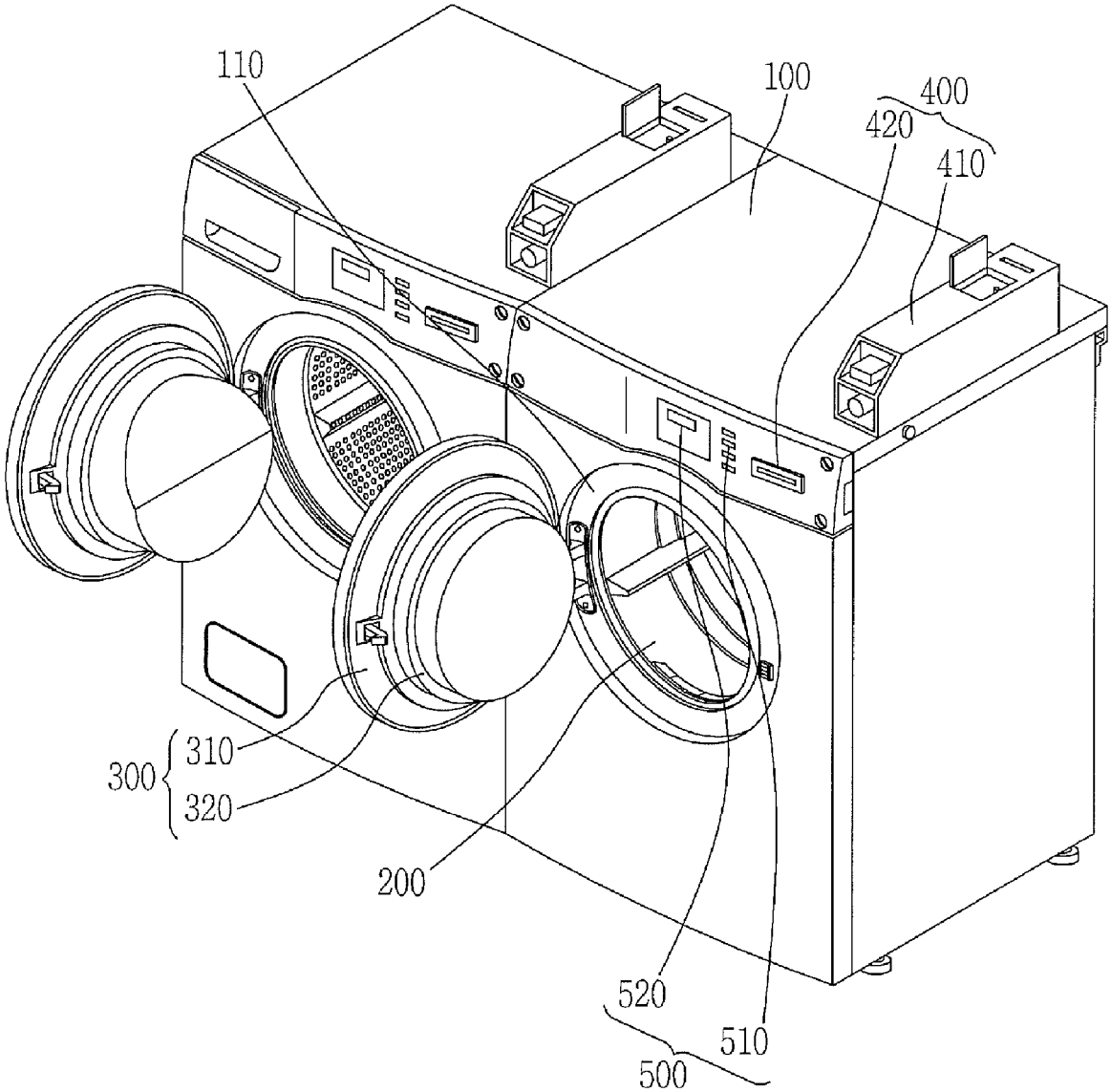
FIG. 2 is a diagram illustrating a laundry room machine according to an embodiment of the present invention.

FIG. 2 is a diagram illustrating a laundry room machine according to an embodiment of the present invention.

Referring to FIG. 2, the laundry room machine according to the present embodiment includes a body 100, a drum 200, a door 300, a payment device 400, and a control unit 500.

The body 100 is formed in a hollow shape so the drum 200 can be disposed in the body 100. An opening 110 is formed at one side of the body 100. In the present embodiment, the body 100 is formed in a hexahedron box shape, and the opening 110 is formed in a circle shape.

The drum 200 houses the laundry and is rotatably disposed in the body 100. In the present embodiment, the drum 200 has a cylindrical shape having one side opened and the other closed. In order to enable a user to put the laundry in the drum 200 or to take the laundry out from the drum 200 through the opening 100 of the body 100, the opened side of the drum 200 is arranged to face the opening 110 of the body 100. It is preferable that the drum 200 is made of thermal resistance material for standing heat generated when the laundry is dried.

The door 300 is connected to the opening 110 to open and close the drum 200. In the present embodiment, the door 300 includes a frame 310 and an opening and closing member 320. The frame 310 is formed in a ring disk shape and has one side connected to the opening 110 through a hinge. The opening and closing member 320 is disposed in the frame 310. Since the opening and closing member 320 is formed in a basket shape, the opening and closing member 320 opens and closes the opening 110 of the body 100 and the opened one side of the drum 200 at the same time. It is preferable that the opening and closing member 320 is made of a transparent material to enable a user to see through the inside of the drum 200.

The payment device 400 is disposed at the body 100 to collect a payment for operating the laundry room machine In the present embodiment, the payment device 400 receives coins or a card as the payment. That is, a coin drop assembly 410 is disposed on a top of the body 100 to collect coins, and a card reader 420 is disposed at an upper front side of the body 100 to receive the card.

The control panel 500 receives payment collection information from the payment device 400 when a user inserts a payment and controls the laundry room machine to supply hot air to the laundry for a predetermined time according to a selected drying course. In the present embodiment, the control panel 500 is disposed at an upper front side of the body 100 and includes an input unit 510 and a display unit 520. The input unit 510 includes buttons for setting one of drying courses. The display unit 520 displays numbers, characters, symbols, and figures to shown information about a state of setting a drying course and a remaining time.

Figure 3:
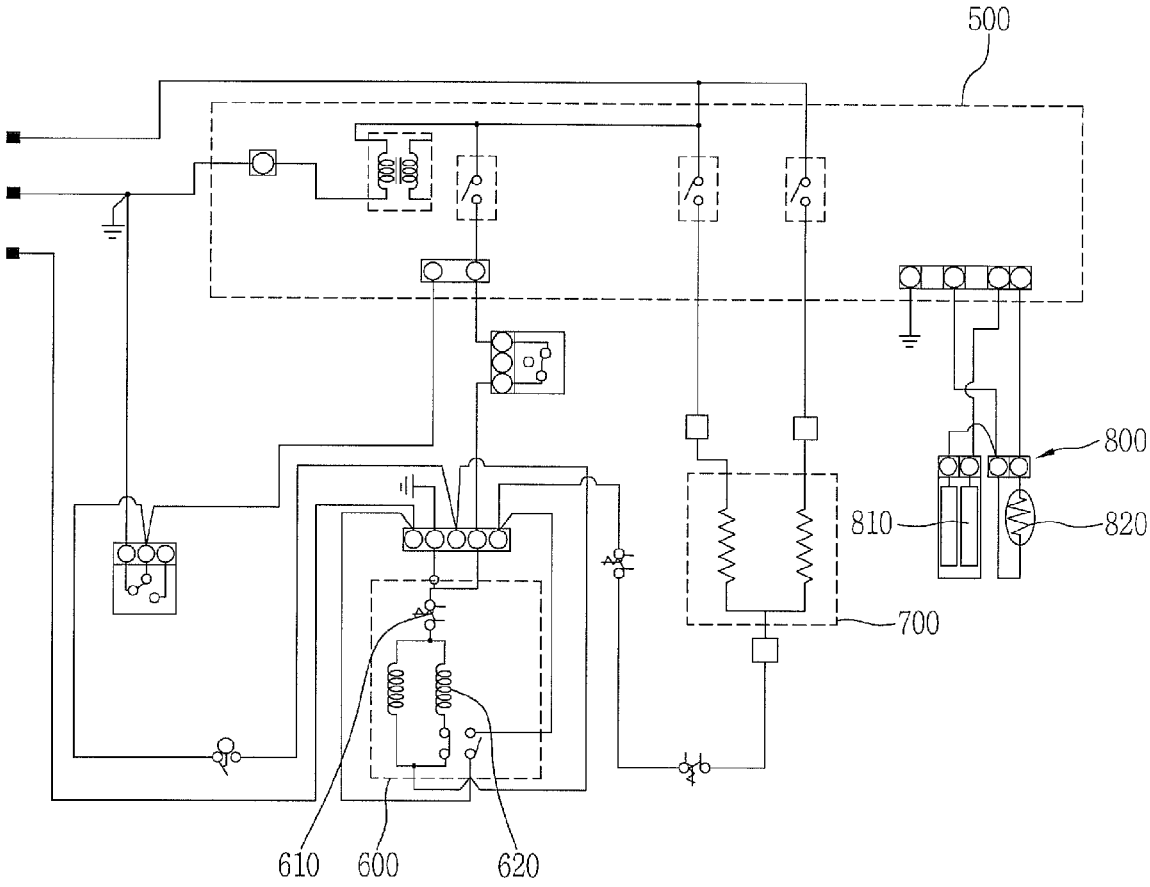
FIG. 3 is a circuit diagram illustrating a laundry room machine according to an embodiment of the present invention.

FIG. 3 is a circuit diagram illustrating a laundry room machine according to an embodiment of the present invention.

Referring to FIG. 3, the laundry room machine includes a motor 600, a heater 700, a sensor 800, and a control panel 500.

The motor 600 is disposed in the body 100 and connected to the drum 300 for rotating the drum 200. In the present embodiment, the motor 600 includes an overload protector 610 for preventing the motor 600 from being overheated when too much laundry is loaded in the drum 200, and a sensing switch 620 for sensing a centrifugal force made by the rotation of the motor 600.

The heater 700 is disposed in the body 100 to supply hot air to the laundry loaded in the drum 200. In the present embodiment, an electrical heater is used as the heater 700. However, a gas heater 700 may be used.

The sensor 800 measures an inside state of the drum 200 in order to detect a state of the laundry. In the present embodiment, the sensor 800 includes a humidity sensor 810 and a temperature sensor 820. It is preferable that the humidity sensor 810 may be disposed at the drum 200 to measure the inside humidity and the temperature sensor 820 is disposed at the drum 200 to measure temperature in the drum 200.

The control panel 500 is connected to the payment device 400 through an interface to receive information about the insertion of a payment. The control panel 500 receives the payment insertion information from the payment device 400, controls the power supplied to the heater to supply hot air to the laundry for a predetermined time according to a drying course selected through the input unit 510, and controls the power to the motor 600. Also, the control panel 500 receives information about the inside humidity and temperature of the drum 200 measured from the sensor 800.

Figure 4:
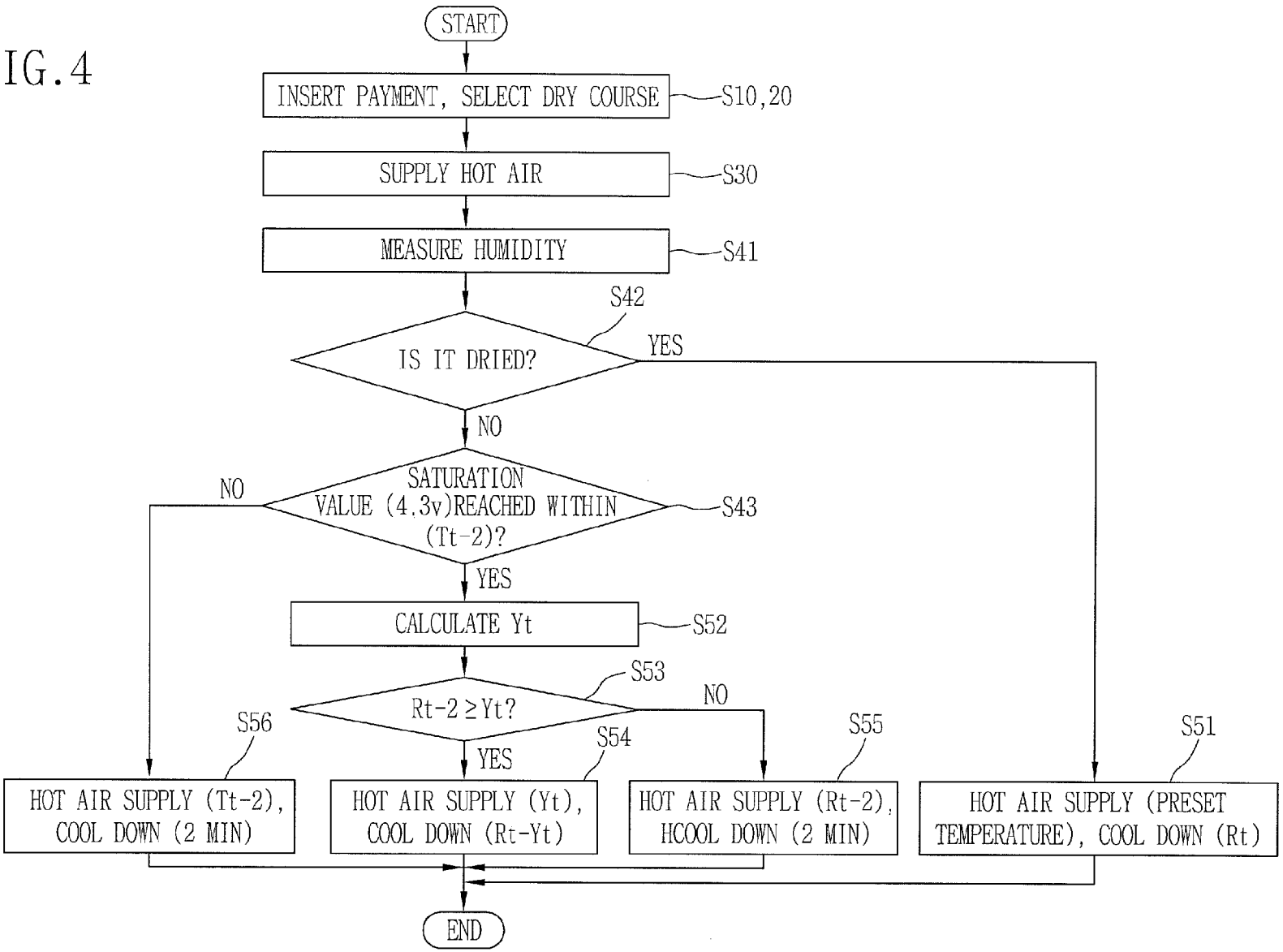
FIG. 4 is a flowchart illustrating a drying method of a laundry room machine according to an embodiment of the present invention.

FIG. 4 is a flowchart illustrating a drying method of a laundry room machine according to an embodiment of the present invention.

Referring to FIG. 4, the drying method according to the present embodiment includes a payment collecting step S10, a drying course setting step S20, a hot air supplying step S30, and a first drying process step S41 to S43, and a second drying process step S51 to S56.

In more detail, a payment for operating a laundry room machine is collected from a user at step S10, and a user selects a drying course according to the laundry at step S20. Then, a hot air is supplied to the laundry for a predetermined time set according to the selected drying course at step S30. In the drying course selecting step S20, a first drying course, a second drying course, and a third drying course are provided to a user, and each of the drying courses includes a first level, a second level, and a third level. Accordingly, a user can choose one of the provided drying courses in order to set the laundry room machine to dry the laundry according to a condition of the laundry. Therefore, the laundry room machine can perform an effective drying operation according to the condition of the laundry.

The condition of the laundry is detected by measuring the humidity of the laundry at steps S41 to S43. In the present embodiment, the first drying process step includes a valid data extracting step S41, and determination steps S42, and S43.

That is, an average value of data $n_{m\{m=0.1.2.3,\ldots,57,58,59\}}$, which are measured for a predetermined sampling time, is calculated at step S41. The humidity sensor 810 measures the inside humidity of the drum 200 and generates the data based on the measured humidity to measure the humidity of the laundry. In the present embodiment, each of valid data $D_{n\{n=1,2,3,\ldots\}}$ is an average value of 60 data measured for a sampling time of about 100 ms. Accordingly, one valid data $D_{n\{n=1,2,3\ldots\}}$ is extracted at an interval of 100 ms. Since the valid data $D_{n\{n=1,2,3,\ldots\}}$ is data for measuring the humidity, the valid data has a voltage unit. That is, the control panel 500 generates the valid data based on data $n_{m\{m=0.1.2.3,\ldots,57,58,59\}}$ generated and transmitted from the humidity sensor 810 by sensing the humidity for a sampling time.

In the present embodiment, the valid data is calculated using Equation 1 at the valid data extracting step S41.

$$(n_0+n_1+n_2+n_3+\ldots+n_{57}+n_{58}+n_{59})/60=D_1$$

$$(n_0\mathbf{30}\ n_1+n_2+n_3+\ldots+n_{57}+n_{58}+n_{59})/60=D_2$$

$$(n_0+n_1+n_2+n_3+\ldots+n_{57}+n_{58}+n_{59})/60=D_3$$

$$(n_0+n_1+n_2+n_3+\ldots+n_{57}+n_{58}+n_{59})/60=D_n \qquad \text{Equation 1}$$

After extracting the average value at step S41, it is determined whether or not the extracted average value is corresponding to a saturation value at steps S42 and S43. That is, the humidity content of the laundry, the condition of the laundry, is determined. In the present embodiment, the saturation value is set as about 4.3V, and the saturation value is compared with the valid data $D_{n\{n=1,2,3,\ldots\}}$ extracted by the humidity sensor 810. If the valid data $D_{n\{n=1,2,3,\ldots\}}$ reaches the saturation value after the hot air is supplied, the control panel 500 determines that the laundry is completely dried at step S42. In the present embodiment, it is determined whether the valid data $D_{n\{n=1,2,3\ldots\}}$ reaches the saturation value 4.3 V within about two minutes after the hot air is supplied at step S42. After two minutes passes, it is determined weather the valid data $D_{n\{n=1,2,3\ldots\}}$ reaches the saturation value of 4.3V within a time left after subtracting two minutes from an initially set total dry time Tt at step S43.

After determining the laundry condition at steps S42 and S43, a hot air supplying time is adjusted according to the determined laundry condition at steps S51 to S56. That is, the hot air supplying time may be sustained or reset according to the determined laundry condition. In the present embodiment, if it is determined that the laundry is dried within about two minutes after supplying the hot air at step S42, the supplement of hot air stops after supplying the hot air until an inside temperature reaches a preset temperature. It is preferable to set the preset temperature in a range of from 50° C. to 70° C. not to damage the laundry. After the inside temperature reaches the preset temperature, the control panel 500 stops the supplement of the hot air and cools the laundry down.

In the present embodiment, the laundry is cooled down for a remaining time Rt, that is, a time left after subtracting a time taken for stopping the hot air from the initially set total dry time Tt set at the step S20.

Then, the hot air is supplied until a shorter time between a dry completion time Yt and the remaining time Rt at step S53. The dry completion time Yt is calculated by a time when the extracted valid data reaches the saturation data at step S52, and the time Rt is a time set at the drying course setting step. In the present embodiment, the step S53 is performed when the valid data extracted within about two minutes after supplying the hot air does not reach to the saturation value of about 4.3V. In the present embodiment, a dry completion value is calculated by Equation 2.

Equation 2

1. in the first level, dry completion time (Yt) by first dry operation=0.5 Tsat+60 sec.

dry completion time (Yt) by second dry operation=0.25 Tsat+200 sec.

dry completion time (Yt) by third dry operation=0.25 Tsat+900 sec.

2. in the second level, dry completion time (Yt) by first dry operation=0.5 Tsat+60 sec.+5 min.

dry completion time (Yt) by second dry operation=0.25 Tsat+200 sec.+4 min dry completion time (Yt) by third dry operation=0.25 Tsat+900 sec.+4 min 3. in the third level, dry completion time (Yt) by first dry operation=0.5 Tsat+60 sec.+10 min.

dry completion time (Yt) by second dry operation=0.25 Tsat+200 sec.+9 min dry completion time (Yt) by third dry operation=0.25 Tsat+900 sec.+9 min In Equation 2, Tsat denotes a time sec when extracted valid data $D_{n\{n=1,2,3,\ldots\}}$ reaches 4.3V The control panel 500 compares the dry completion time Yt calculated by Equation 2 with the remaining time Rt at step S53.

If the dry completion time Yt is equal or shorter than a time left after subtracting two minute from the remaining time Rt at step S53, the hot air is supplied to the laundry for the dry completion time Yt. At step S54, the laundry is cooled down for a time left after subtracting the dry completion time Yt from the remaining time Rt by stopping the supplement of the hot air stops after the dry completion time Yt.

If the dry completion time Yt is longer a time left after subtracting two minute from the remaining time Rt at step S53, the hot air is supplied to the laundry for a time left after subtracting two minutes from the remaining time Rt. Then, the laundry is cooled down for two minutes by stopping the hot air at step S55.

Finally, if the valid data $D_{n\{n=1,2,3,\ldots\}}$ extracted within a time left after subtracting two minutes from the initial set total time Tt at step S43 does not reach to the saturation value of about 4.3V, the hot air is supplied to the laundry for a time left after subtracting two minutes from the initial set total time Tt, and the laundry is cooled down for two minutes by stopping the hot air at step S56.

Table 1 shows times of supplying a hot air, which are adjusted according to the measurement of the dry completion time Yt at steps S51 to S56.

TABLE 1

| | Tt | Lt | Rt | Yt | Drying step | Cooling step | Unit |
|---|---|---|---|---|---|---|---|
| 1 | 45 | 25 | 20 | 10 | 10 | 10 | Min |
| 2 | 45 | 25 | 20 | 30 | 18 | 2 | Min |
| 3 | 45 | 25 | 20 | 5 | 5 | 15 | Min |
| 4 | 45 | 25 | 20 | 20 | 18 | 2 | Min |

In Table 1, Tt denotes a total dry time, Lt denotes a passage time, Rt denotes a remaining time, and Yt denotes a dry completion time.

As described above, the drying operation can be performed without damaging the laundry, and the electric power supplied to the heater 700 can be saved.

Hereinafter, a drying method when a user additionally inserts a payment into a payment device while the second drying process step according to an embodiment of the present invention is performing will be described.

Figure 5:
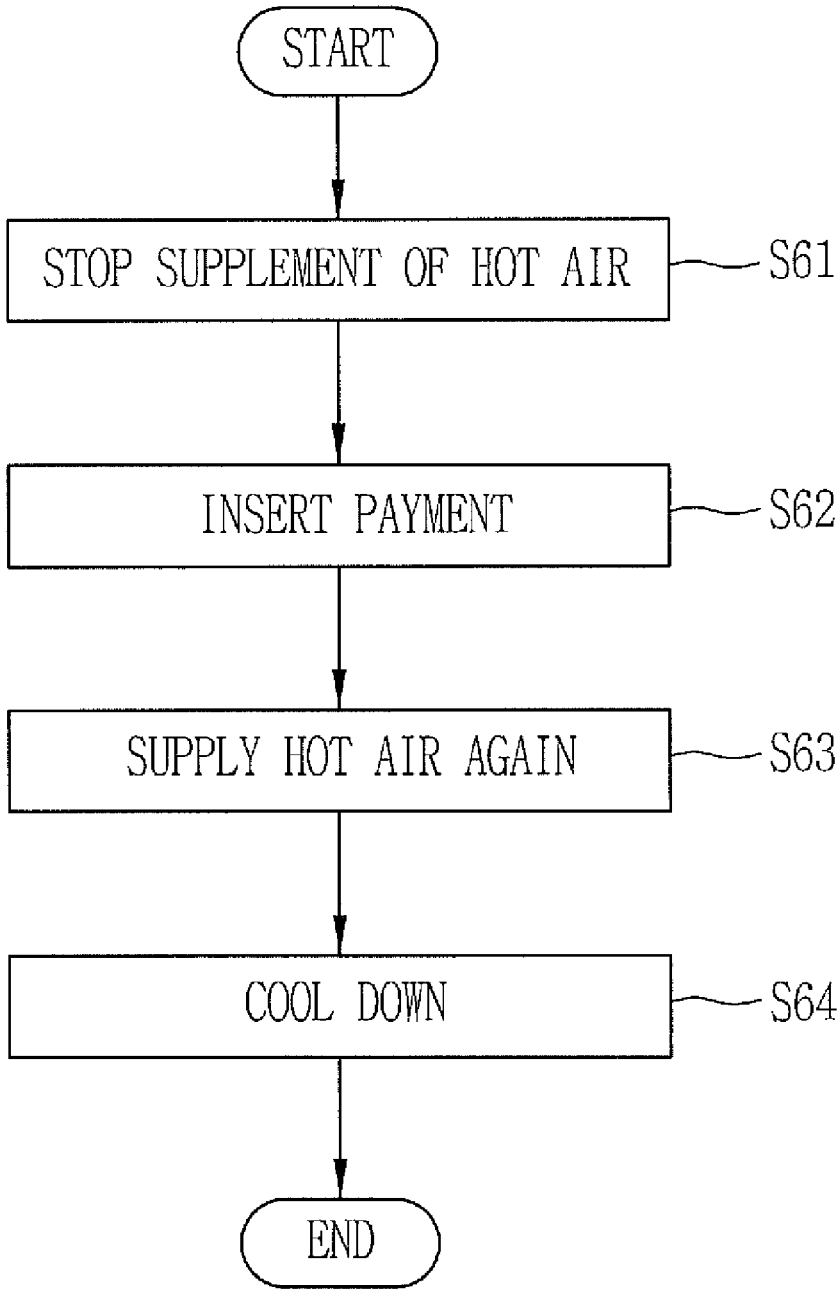
FIG. 5 is a flowchart illustrating a drying method of a laundry room machine when a payment is additional inserted in a payment device of the laundry room machine.

FIG. 5 is a flowchart illustrating a drying method of a laundry room machine when a payment is additional inserted in a payment device of the laundry room machine.

Referring to FIG. 5, the supplement of the hot air stops at step S61 because the total dry time of the selected course is adjusted. Then, the control panel 500 receives information about the insertion of additional payment from the payment device 400 at step S62, and the control panel 500 controls the heater 700 to supply a hot air to the laundry again at step S63. That is, the laundry room machine determines that a user wants to forcedly dry the laundry, and supplies hot air to the laundry as long as a previously set time according to the additionally inserted payment.

In the present embodiment, a laundry room machine may be set to increase a time of supplying a hot air by 15 minutes per a coin of 25 cents or by 15 minutes per one time of card charging. After the hot air is supplied as long as the set time, the laundry is cooled down by stopping the hot air at step S64.

According to the certain embodiment of the present invention, the laundry can be prevented from being damaged by providing discriminative drying courses according to the moisture content of the laundry.

Also, energy for drying the laundry can be saved by ending a drying operation if it is determined that the drying operation dose not need to be performed any longer by measuring a condition of the laundry Furthermore, a user is allowed to extend a drying time while a drying operation is performing.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A drying method for a laundry room machine that includes a payment device that collects payment for operation of the laundry room machine for a preset dry time corresponding to a selected drying course upon receiving payment insertion information from the payment device, the drying method comprising:

determining a condition of laundry items received in a drum of the laundry room machine by measuring a humidity level in the drum; and when it is determined that the laundry items are dried within a first predetermined time that is less than the preset dry time, sustaining a supply of hot air to the laundry items in the drum up to a predetermined temperature and then cooling the laundry items in the drum during a remaining preset dry time;

when it is determined that the laundry items are not dried within the first predetermined time and that the laundry items are dried within a second predetermined time that is between the preset dry time and the first predetermined time, resetting a hot air supplying time and a cooling time so that a sum of the hot air supplying time and the cooling time does not exceed the remaining preset dry time; and when it is determined that the laundry items are not dried within the first predetermined time and that the laundry items are not dried within a time difference between the preset dry time and the first predetermined time, stopping a supply of hot air to the laundry items in the drum and then cooling the laundry items in the drum during the first predetermined time.

2. The drying method of claim 1, wherein determining the condition of the laundry items received in the drum includes extracting a data value that is an average value of humidity data measured during a sampling time, and wherein determining the condition of the laundry items includes determining whether the extracted data value reaches a predetermined saturation value.

3. The drying method of claim 1, wherein if a determined drying time (Yt) of the laundry items is less than the time difference between the remaining preset dry time (Rt) and the second predetermined time, the method further comprises supplying hot air to the laundry during the determined drying time (Yt) and performing a cooling down of the laundry items during a time Rt−Yt, and if the determined drying time of the laundry items (Yt) is greater than the time difference between the remaining preset dry time (Rt) and the second predetermined time, the method further comprises supplying hot air to the laundry items during the time difference between the remaining preset dry time and the second predetermined time and performing a cooling down during the second predetermined time.

4. The drying method of claim 3, wherein the first predetermined time is the same as the second predetermined time.

5. The drying method of claim 1, wherein, when supplemental payment insertion information is received after a supply of hot air is stopped, the method further comprises supplying hot air to the laundry items again.

6. A commercial dryer for a commercial laundry room, the commercial dryer comprising:

a humidity sensor that measures a humidity of laundry items in the dryer; and controller installed at the dryer that communicates payment collection information with a payment device disposed at the dryer, the controller including a preset operating condition including a hot air supplying time and a cooling down time corresponding to the payment collection information, wherein the controller controls operation of the dryer according to the preset operating condition, and resets the operating condition according to information provided by the humidity sensor within an initially preset total drying time associated with the preset operating condition.

7. The commercial dryer of claim 6, wherein the controller resets the preset operating condition in response to additional payment collection information.

8. The commercial dryer of claim 6, wherein the controller resets the hot air supplying time and the cooling down time according to information from the humidity sensor within the initially preset total drying time.

* * * * *